US005743331A

United States Patent [19]

Adkins et al.

[11] Patent Number: 5,743,331

[45] Date of Patent: Apr. 28, 1998

[54] WELLBORE MILLING SYSTEM

[75] Inventors: Courtney W. Adkins, Katy; Thurman B. Carter; William A. Blizzard, Jr., both of Houston; Richard M. Ward, Conroe, all of Tex.

[73] Assignee: Weatherford/Lamb, Inc., Houston, Tex.

[21] Appl. No.: 715,573

[22] Filed: Sep. 18, 1996

[51] Int. Cl.[6] ..... E21B 29/00

[52] U.S. Cl. ..... 166/55.7; 166/117.6; 166/334.4

[58] Field of Search ..... 166/55.7, 117.6, 166/334.4, 332.2, 321, 319, 213, 212, 206, 240

[56] References Cited

U.S. PATENT DOCUMENTS

| | | | |
|---|---|---|---|
| 1,794,652 | 3/1931 | Stone . | |
| 2,893,491 | 7/1959 | Crowe | 175/86 |
| 3,095,039 | 6/1963 | Kinzbach | 166/117.6 |
| 3,908,759 | 9/1975 | Cagle et al. | 166/117.6 |
| 3,986,554 | 10/1976 | Nutter | 166/240 X |
| 4,153,109 | 5/1979 | Szescila | 166/250 |
| 4,266,621 | 5/1981 | Brock | 175/329 |
| 4,270,608 | 6/1981 | Hendrickson et al. | 166/278 |
| 4,273,464 | 6/1981 | Scott | 403/348 |
| 4,285,399 | 8/1981 | Holland et al. | 166/113 |
| 4,296,807 | 10/1981 | Hendrickson et al. | 166/240 X |
| 4,321,965 | 3/1982 | Restarick et al. | 166/117.5 |
| 4,397,355 | 8/1983 | McLamore | 166/297 |
| 4,765,404 | 8/1988 | Bailey et al. | 166/117.6 |
| 4,889,199 | 12/1989 | Lee | 175/317 |
| 5,010,955 | 4/1991 | Springer | 166/298 |
| 5,109,924 | 5/1992 | Jurgens et al. | 166/117.5 |
| 5,154,231 | 10/1992 | Bailey et al. | 166/298 |
| 5,193,620 | 3/1993 | Braddick | 166/382 |
| 5,195,591 | 3/1993 | Blount et al. | 166/380 |
| 5,318,132 | 6/1994 | Odorisio | 166/382 |
| 5,339,914 | 8/1994 | Lee | 175/73 |
| 5,341,873 | 8/1994 | Carter et al. | 166/117.5 |
| 5,390,739 | 2/1995 | Tuilby | 166/212 |
| 5,425,419 | 6/1995 | Sieber | 166/206 |
| 5,443,129 | 8/1995 | Bailey et al. | 166/117.6 X |
| 5,488,989 | 2/1996 | Leising et al. | 166/117.6 X |
| 5,499,687 | 3/1996 | Lee | 175/317 |
| 5,592,991 | 1/1997 | Lembcke et al. | 166/298 |
| 5,597,016 | 1/1997 | Manke et al. | 138/46 |

OTHER PUBLICATIONS

"Multiple Activation Bypass System," PBL Drilling Tools, Ltd., 1995.

"Casing Sidetrack Systems," AZ Grant Int'l, 1994.

*Primary Examiner*—William P. Neuder

*Attorney, Agent, or Firm*—Guy McClung

[57] ABSTRACT

The present invention, in one aspect, discloses a system for selectively anchoring a wellbore tool at a desired location in a wellbore or tubular member such as casing or tubing; such a system with a selectively settable anchor assembly that has a piston that is moved upwardly by fluid under pressure from the surface thereby moving one or more movable slips out from a body of the anchor assembly to set the anchor assembly in place; and such a system with a whipstock connected to the anchor assembly. Fluid under pressure pumped from the surface down a workstring to which the system is connected flows to the anchor assembly through or adjacent the whipstock. In one aspect a mill (or mills) is releasably connected to the whipstock. In one aspect, fluid under pressure flows through or adjacent the mill(s) to the whipstock.

In one aspect a selectively actuable valve assembly is provided for selectively controlling the flow of fluid under pressure from an inlet end of the valve assembly out through an outlet end thereof for flow, e.g., to a mill, whipstock and/or anchor assembly. In one aspect such a valve assembly is used with a system as previously described to selectively provide actuating fluid under pressure to an anchor assembly as described to set the movable slip(s) thereof and, in one aspect, to then provide jetting fluid to jetting ports of the mill(s) upon release of the mill(s) from a whipstock.

13 Claims, 12 Drawing Sheets

576
504
502
503
507
506
501
507
511
510
508
581
580
509
582
507
506
550
507
505
509
549
521
575
563
574
561
520
547
560
548
573
541
545
562
544
540
543
523
522
546
532
532
530
542
572
533
571
531

POSITION 1.
Fill ports open

POSITION 2.

Circulate ports open

POSITION 3.

All ports closed

POSITION 4.

Setting ports open

POSITION 5.

All valve ports closed

Mill ports open

POSITION 6.

Circulate ports open

WELLBORE MILLING SYSTEM

BACKGROUND OF THE INVENTION

1. Field of the Invention

This invention is related to wellbore milling processes; milling tools and whipstocks and anchors for them; and in one aspect to single-trip milling methods and systems.

2. Description of Related Art

Milling tools are used to cut out windows or pockets from a tubular, e.g. for directional drilling and sidetracking; and to remove materials downhole in a well bore, such as pipe, casing, casing liners, tubing, or jammed tools. The prior art discloses various types of milling or cutting tools provided for cutting or milling existing pipe or casing previously installed in a well. These tools have cutting blades or surfaces and are lowered into the well or casing and then rotated in a cutting operation. With certain tools, a suitable drilling fluid is pumped down a central bore of a tool for discharge beneath the cutting blades and an upward flow of the discharged fluid in the annulus outside the tool removes from the well cuttings or chips resulting from the cutting operation.

Milling tools have been used for removing a section of existing casing from a well bore to permit a sidetracking operation in directional drilling, to provide a perforated production zone at a desired level, to provide cement bonding between a small diameter casing and the adjacent formation, or to remove a loose joint of surface pipe. Also, milling tools are used for milling or reaming collapsed casing, for removing burrs or other imperfections from windows in the casing system, for placing whipstocks in directional drilling, or for aiding in correcting dented areas of casing or the like. Prior art sidetracking methods use cutting tools of the type having cutting blades and use a deflector such as a whipstock to cause the tool to be moved laterally while it is being moved downwardly in the well during rotation of the tool, to cut an elongated opening pocket or window in the well casing.

Certain prior art operations which employ a whipstock also employ a variety of tools used in a certain sequence. That requires a plurality of "trips" into the wellbore. For example, a false base (e.g. a plug, bridge plug, packer or anchor packer) is set in a casing or in a borehole that serves as a base on which a whipstock can be set. Certain prior art whipstocks have a movable plunger which acts against such a false base. In certain multi-trip operations, a packer is oriented and set in a wellbore at a desired location. This packer acts as an anchor on or against which tools above it may be urged to activate different tool functions. The packer typically has a key or other orientation indicating member. The packer's orientation is checked by running a tool such as a gyroscope indicator into the wellbore. In this case a whipstock-mill combination tool is then run into the wellbore by first properly orienting a stinger at the bottom of the tool with respect to a concave face of the tool's whipstock or by using an MWD tool. Splined connections between a stinger and the tool body facilitate correct stinger orientation. A starting mill is secured at the top of the whipstock, e.g. with a setting stud and nut. The tool is then lowered into the wellbore so that the packer engages the stinger and the tool is oriented. Slips extend from the anchor and engage the side of the wellbore to prevent movement of the tool in the wellbore. Pulling or pushing on the tool then shears the setting stud, freeing the starting mill from the tool. Rotation of the string with the starting mill rotates the mill. The starting mill has a tapered portion which is slowly lowered to contact a pilot lug on the concave face of the whipstock. This forces the starting mill into the casing to mill off the pilot lug and cut an initial window in the casing. The starting mill is then removed from the wellbore. A window mill, e.g. on a flexible joint of drill pipe, is lowered into the wellbore and rotated to mill down from the initial window formed by the starting mill. Typically then a window mill with a watermelon mill mills all the way down the concave face of the whipstock forming a desired cut-out window in the casing. This may take multiple trips. Then, the used window mill is removed and a new window mill and string mill and a watermelon mill are run into the wellbore with a drill collar (for rigidity) on top of the watermelon mill to lengthen and straighten out the window and smooth out the window-casing-open-hole transition area. The tool is then removed from the wellbore. The prior art also discloses a variety of single-trip milling systems each of which requires that a packer, bridge plug, anchor packer, or other securement be provided as a base in a tubular upon which to position the milling.

There has long been a need for an efficient and effective single-trip milling method and systems for effecting the method. There has long been a need for tools useful in such a method. There has long been a need for such systems which do not require a base upon which the system is emplaced and/or which have a selectively settable anchor apparatus which does not require the dropping of a ball, dart, etc.

SUMMARY OF THE PRESENT INVENTION

The present invention, in one embodiment, discloses a system for selectively anchoring a wellbore tool at a desired location in a wellbore or tubular member such as casing or tubing. In one aspect the system has a selectively settable anchor assembly that has a piston that is moved upwardly by fluid under pressure from the surface. The piston moves apparatus that pushes one or more movable slips out from a body of the anchor assembly to set the anchor assembly in place.

In one aspect the system as described above has a whipstock connected to the anchor assembly. Fluid under pressure flows to the anchor assembly through the whipstock and/or through tubing on the exterior of the whipstock. In one aspect the whipstock is selectively releasably connected to the anchor assembly. In one aspect a mill (or mills) is releasably connected to the whipstock. In one aspect, fluid under pressure flows through the mill(s) to the whipstock (e.g. but not limited to through a channel in a mill, through a shear stud, through a pilot lug on the mill, and through a channel through the mill intercommunicating with the anchor assembly) or fluid under pressure flows through the mill, through exterior tubing to the whipstock, and through the whipstock to the anchor assembly.

In one aspect a selectively actuable valve assembly is provided according to the present invention for selectively controlling the flow of fluid under pressure from an inlet end of the valve assembly out through an outlet end thereof. In one aspect such a valve assembly has a rotatable ratchet sleeve which (in being moved upwardly or downwardly by members responding to increased or decreased fluid pressure) rotates to selectively maintain the valve assembly in a plurality of positions so that fluid under pressure either flows through selected ports to selected flow lines or does not flow at all. In one aspect such a valve assembly is used with a system as previously described to selectively provide actuating fluid under pressure to an anchor assembly as described to set the movable slip(s) thereof and, in one aspect, to then provide jetting fluid to jetting ports of the mill(s).

The present invention teaches, in certain embodiments, a system as described herein wherein the valve assembly of the system provides selective circulation or pressurization while a pump at the surface is engaged, the pump providing fluid under pressure to the valve assembly; such a system that provides fluid communication between the inside and the outside of the drillstring while the pumps are not pumping fluid under pressure; such a system wherein the system may be run in the hole on a drillstring so that the drill string fills up with fluid from outisde the system that flows into the system to the interior of the drillstring through the system, e.g., to inhibit buoyancy of the drillstring in the hole; such a system which does not require that anything be dropped down thereinto in order to actuate parts of the system or provide for flow of fluid under pressure to and through selected desired conduits and channels; a valve assembly as shown or described herein and such a valve assembly with mill(s) releasably attached thereto, directly or indirectly, the valve assembly in fluid communication with the mill(s); such a valve assembly with a whipstock interconnected therewith, directly or indirectly, and in fluid communication therewith; such a valve assembly interconnected with, directly or indirectly, an anchor assembly as shown or described herein, the valve assembly in fluid communication with the anchor asembly; and an anchor assembly as shown or described herein with a mill and/or whipstock and/or valve assembly as shown or described herein interconnected therewith and in fluid communication therewith.

It is, therefore, an object of at least certain preferred embodiments of the present invention to provide:

New, useful, unique, efficient, non-obvious selectively actuable wellbore anchoring apparatus; such apparatus in combination with a whipstock; such apparatus and whipstock in combination with one or more mills; valve assemblies for selectively applying fluid under pressure to such apparatus; and milling systems and methods for single-trip milling operations;

A milling method in which a window is milled at a desired location in a tubular; and A system for such a method.

This invention resides not in any particular individual feature disclosed herein, but in combinations of them and it is distinguished from the prior art in these combinations with their structures and functions. There has thus been outlined, rather broadly, features of the invention in order that the detailed descriptions thereof that follow may be better understood, and in order that the present contributions to the arts may be better appreciated. There are, of course, additional features of the invention that will be described hereinafter and which may be included in the subject matter of the claims appended hereto. Those skilled in the art who have the benefit of this invention will appreciate that the conceptions, upon which this disclosure is based, may readily be utilized as a basis for the designing of other structures, methods and systems for carrying out the purposes of the present invention. It is important, therefore, that the claims be regarded as including any legally equivalent constructions insofar as they do not depart from the spirit and scope of the present invention.

The present invention recognizes and addresses the previously-mentioned problems and needs and provides a solution to those problems and a satisfactory meeting of those needs in its various possible embodiments and equivalents thereof. To one of skill in this art who has the benefits of this invention's realizations, teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention as broadly as legally possible no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by references to certain embodiments thereof which are illustrated in the appended drawings, which drawings form a part of this specification. It is to be noted, however, that the appended drawings illustrate certain preferred embodiments of the invention and are therefore not to be considered limiting of its scope, for the invention may admit to other equally effective or equivalent embodiments.

DESCRIPTION OF EMBODIMENTS PREFERRED AT THE TIME OF FILING FOR THIS PATENT

Figure 1:
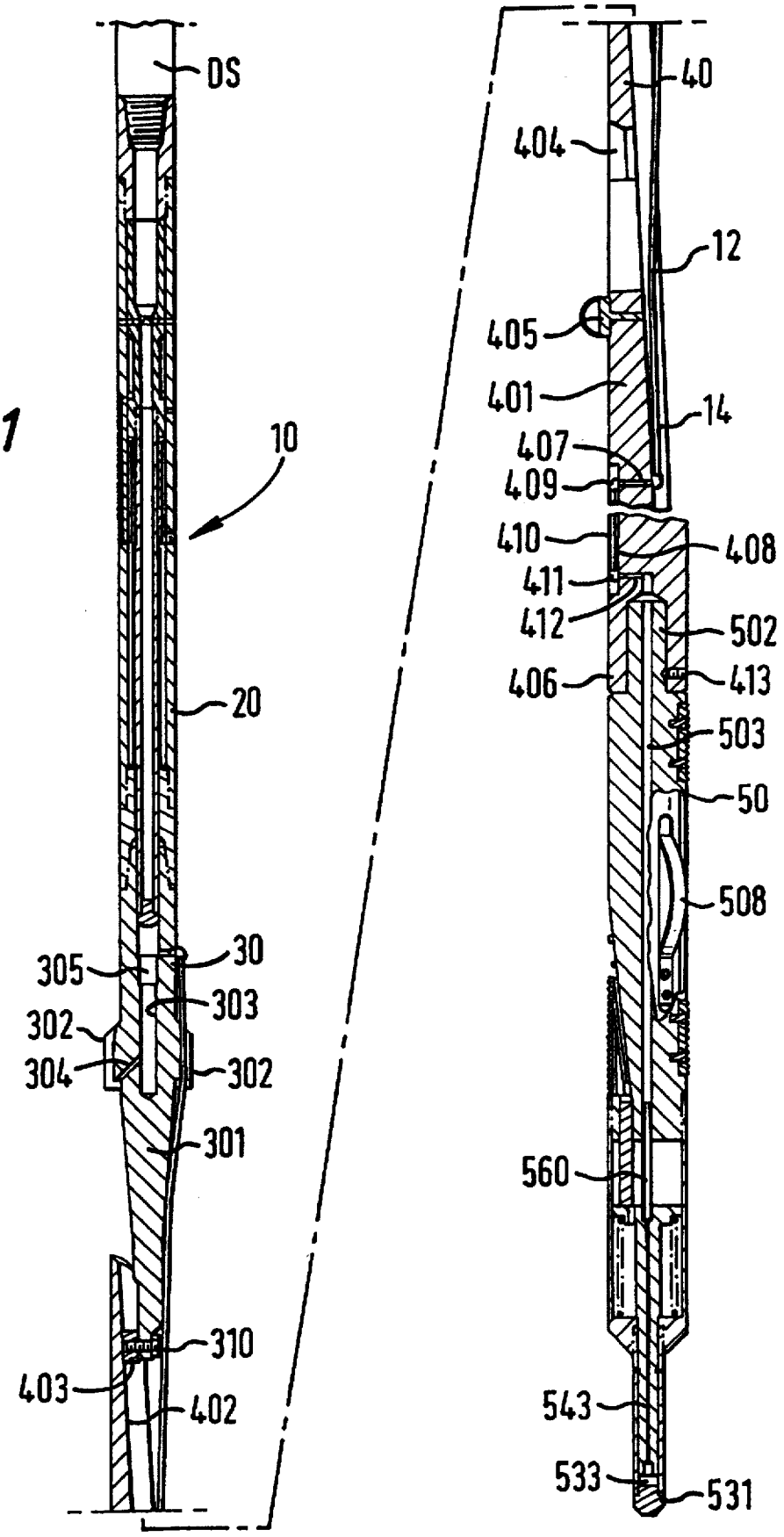
FIG. 1 is a side view in cross-section of a system according to the present invention.

FIG. 1 shows a system 10 according to the present invention with a valve assembly 20, a mill 30, a whipstock 40 and an anchor assembly 50 interconnected with a tubular string, e.g. but not limited to coil tubing or a drill string DS. Tubing 12 conducts fluid under pressure selectively introduced from the surface and through the valve assembly 20 from the mill 30 to the whipstock 40 from which it flows to selectively activate the anchor assembly 50. The system 10 may be run into a hole and/or tubular member string (e.g. a cased hole) and the whipstock may be oriented using known MWD (measurement-while-drilling) devices, gyroscopic orienting apparatus, etc.

Figure 2A:
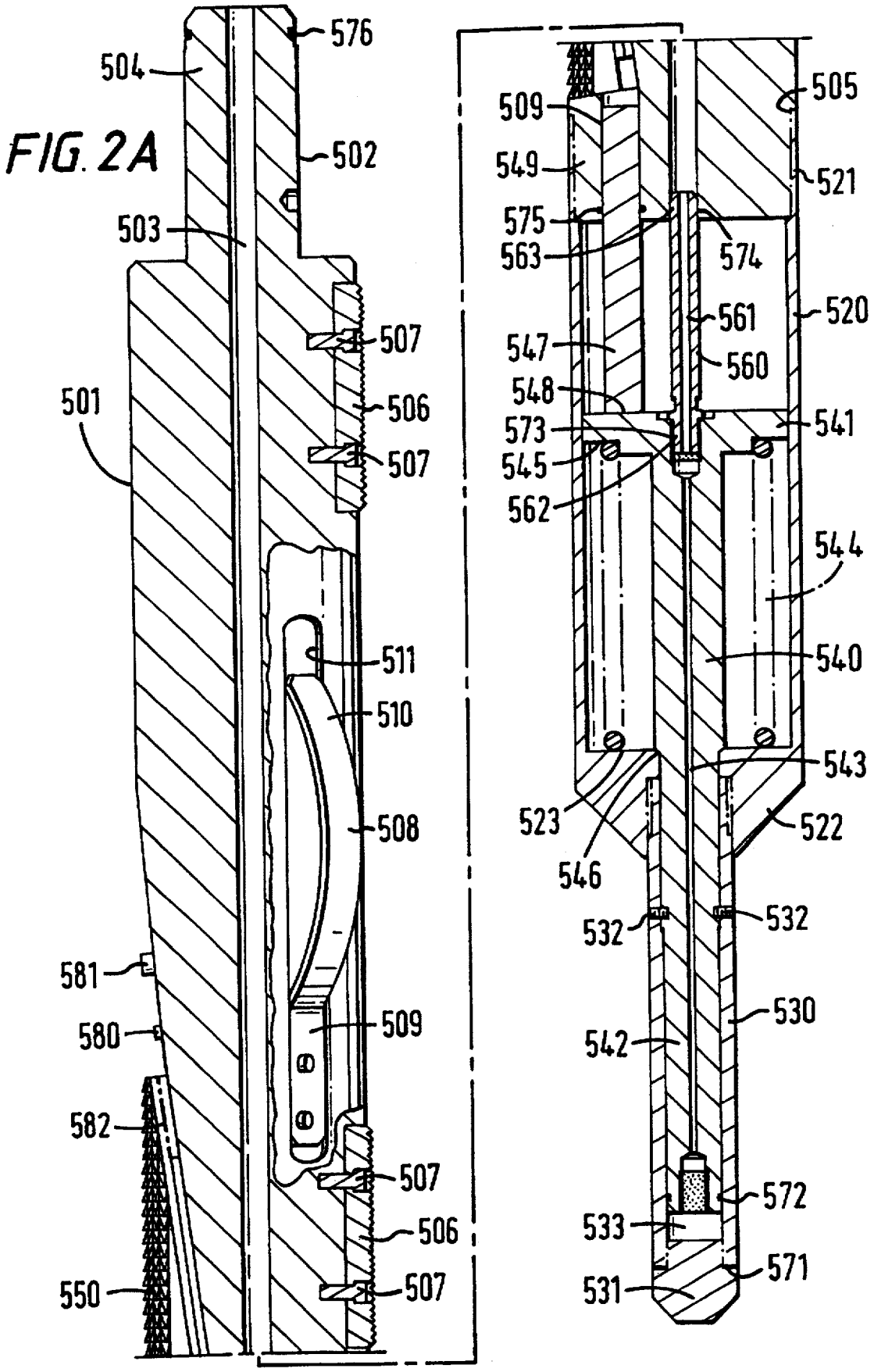
FIG. 2A is a side view in cross-section of the anchor assembly of the system of FIG. 1.
Figure 2B:
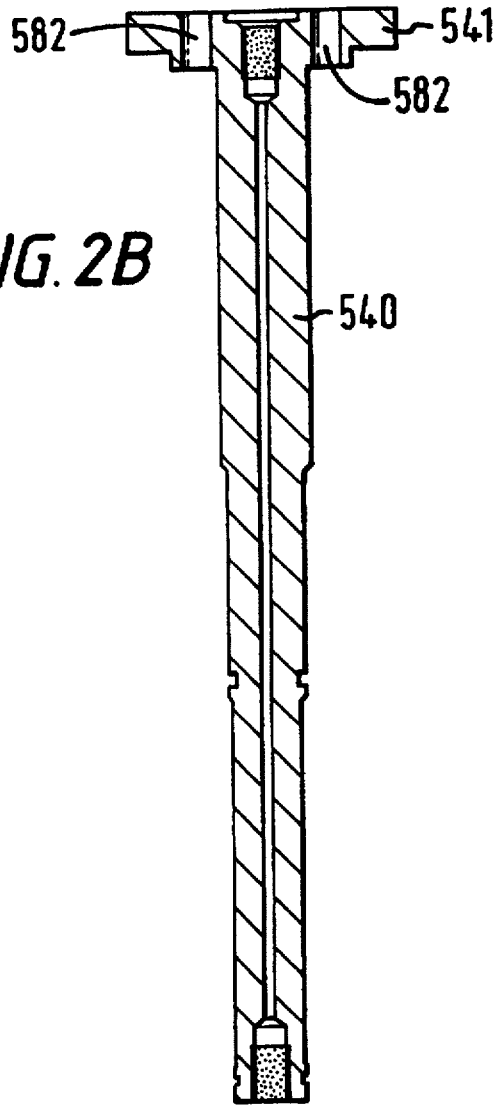
FIG. 2B is a side view in cross-section of the piston assembly of the anchor assembly of FIG. 2A.
Figure 4:
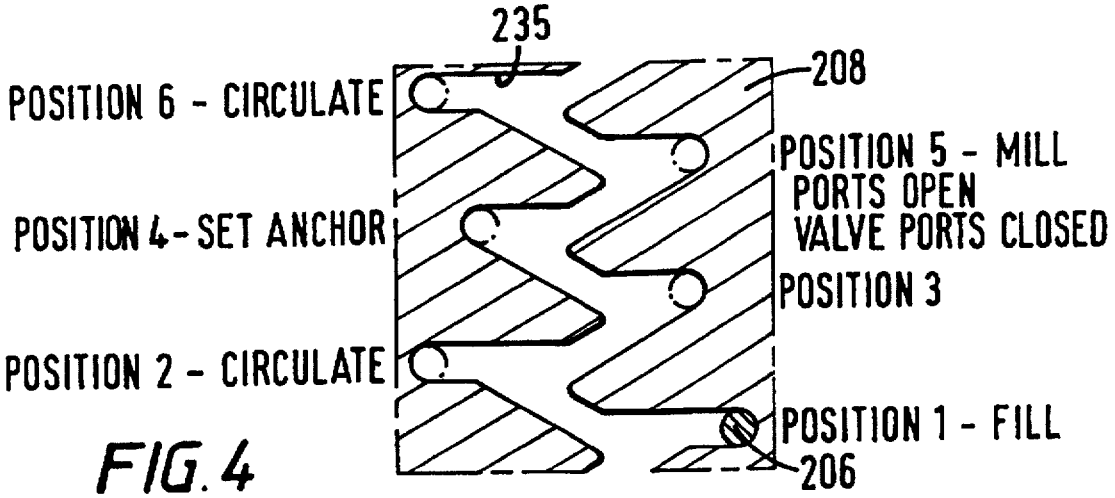
FIG. 4 shows part of a ratchet sleeve of the valve assembly of FIG. 3A.

The anchor assembly 50 as shown in FIG. 2 has a cylindrical body 501 with an upper neck 502; a fluid flow bore 503 from an upper end 504 to a lower threaded end 505; and one, two (or more) stationary slips 506 held to the body 501 with screws 507. One (or more) bow spring 508 has an end 509 screwed to the body to offset the body from the interior of a tubular such as casing through which the body moves to reduce wear thereon and, in one aspect, to inhibit or prevent wear on the stationary slips, the or each bow spring 508 has an end 510 free to move in a recess 511 as the bow spring is compressed or released.

A hollow barrel assembly 520 which is cylindrical has an end 521 threadedly connected to the lower threaded end 505 of the body 501. A hollow anchor sleeve 530 is threadedly connected in a lower end 522 of the hollow barrel assembly 520. A sleeve plug 531 closes off the lower end of the hollow anchor sleeve 530 to fluid flow and is secured to the barrel assembly, e.g. by welding.

A piston assembly 540 has a piston end 541 with fluid flow holes 582 (see FIG. 2A which shows two of four such holes) is mounted for movement within the hollow barrel assembly 520 with a lower end 542 initially projecting into the hollow anchor sleeve 530. Initially movement of the piston assembly is prevented by one or more shear screws 532 extending through the anchor sleeve 530 and into the lower end 542 of the piston assembly 540. In one aspect the shear screws 532 are set to shear in response to a force of about 5000 pounds.

A fluid flow bore 543 extends through the piston assembly 540 from one end to the other and is in fluid communication with a cavity 533 defined by the lower end surface of the piston assembly 540, the interior wall of the anchor sleeve 530, and the top surface of the sleeve plug 531. A spring 544 disposed around the piston assembly 540 has a lower end that abuts an inner shoulder 523 of the hollow barrel assembly 520 and a lower surface 545 of the piston end 541 of the piston assembly 540. Upon shearing of the shear screws 532, the spring 544 urges the piston assembly 540 upwardly. A lower shoulder 546 of the piston assembly 540 prevents the piston assembly 540 from moving any lower than is shown in FIG. 1.

A bar 547 has a lower end 548 resting against the piston end 541 and an upper end 549 that is free to move in a channel 509 of the body 501 to contact and push up on a movable slip 550 movably mounted to the body 501 (e.g. with a known joint, a squared off dovetail joint arrangement, a dovetail joint arrangement, or a matching rail and slot configuration, e.g. but not limited to a rail with a T-shaped end movable in a slot with a corresponding shape).

Fluid under pressure for activating the anchor assembly 50 is conducted from the fluid flow bore 503 of the body 501 to the fluid flow bore 543 of the piston assembly 540 by a hollow stem 560 that has a fluid flow bore 561 therethrough from one end to the other. The hollow stem 560 has a lower end 562 threadedly secured to the piston end 541 of the piston assembly 540 and a upper end 563 which is freely and sealingly movable in the fluid flow bore 503.

A shearable capscrew 580 in the body 501 initially insures that the movable slip 550 does not move so as to project outwardly from the body 501 beyond the outer diameter of the body 501 while the system is being run into a hole or tubular. In order to set the anchor assembly, the force with which the bar 547 contacts and moves the movable slip 550 is sufficient to shear the capscrew 580 to permit the movable slip 550 to move out for setting of the anchor assembly. Initially the capscrew 580 moves in a corresponding slot (not shown) in the movable slip 550. The slot has an end that serves as a stop member that abuts the capscrew 580 and against which the capscrew 580 is pushed to shear it. Similarly the capscrew 581 prevents the movable slip 550 from further movement out from the body 501 as the anchor assembly is being removed from a wellbore and/or tubular member string. The capscrew 581 is held in and moves in a slot in the movable slip 550 and the capscrew 581 thus holds the movable slip 550. This prevents the movable slip 550 from projecting so far out from the body 501 that removal of the anchor assembly is impeded or prevented due to the movable slip 550, and hence the anchor assembly 50, getting caught on or interfering with structure past which it must move to exit the wellbore and/or tubular member string.

Various O-rings (e.g. made of 90 DURO nitrile) seal interfaces as follows: O-ring 571, sleeve-plug 531/hollow-sleeve 530; O-ring 572, lower-end 542/hollow-anchor-sleeve 530; O-ring 573, piston-end 541/lower-end 562; O-ring 574, upper-end 563/body 501; O-ring 575, bar 547/body 501; and, O-ring 576, upper-neck 502/lower-end-of-whipstock 40.

Components of the system may be made of any suitable metal (steel, stainless steel, mild steel, inconel, iron, zinc, brass, or alloys thereof)or plastic. In one aspect the system has two stationary slips and one movable slips. All parts may be painted and/or zinc phosphate coated and oil dipped.

To load the piston assembly in the hollow barrel assembly, the piston assembly may be introduced into the top of the barrel assembly with a threaded rod engaging the lower end of the piston assembly and projecting out from the anchor sleeve. The threaded rod is pulled or rotated until recesses on the piston assembly for receiving the shear screws line up with holes through the barrel assembly through which the shear screws are placed. Once the piston assembly is shear screwed in place and stationary, the threaded rod is disengaged and the sleeve plug is secured in place at the end of the anchor sleeve.

The fluid under pressure for actuating the anchor assembly may be any suitable pumpable fluid, including but not limited to water, hydraulic fluid, oil, foam, air, completion fluid, and/or drilling mud.

Once the movable slip 550 is sufficiently wedged against a casing wall, the spring 544 prevents the piston assembly 540 from moving down to the position shown in FIG. 2A, thus inhibiting or preventing movement of the movable slip 550 which could result in unwanted movement or destabilization of the system 10. This also makes it possible to decrease fluid pressure in the system 10 or to release fluid pressure while the system 10 is maintained in a set position (e.g. when anchoring of the system is verified, e.g. with the system in the position of FIG. 5D, weight is set down on the system 10 to obtain an indication that setting has been achieved, e.g. a surface weight indicator provides such an indication).

The whipstock 40 has a body 401 with a concave 402; a shear lug 403; a retrieval slot 404; a hoisting ring 405; and a lower end 406 for interconnection with the upper neck 502 of the anchor assembly 50. Shear screw(s) 413 extend through the whipstock body 401 and the neck 502 of the anchor assembly 50. These screws may be set to shear, e.g. at about 27,500 pounds.

The tubing 12 has a lower end 14 that communicates with a fluid channel 407 which extends from one side of the whipstock body 401 to a recess 408 where it is connected to a top end 409 of a tubing 410 that has a lower end 411 that communicates with a fluid channel 412 which itself is in fluid communication with the fluid flow bore 503 of the anchor assembly 50. Alternatively the tubing 12 may be directly connected to the anchor assembly 50 or to the fluid channel 412. One or more shear screws 413 releasably hold the anchor assembly 50 to the whipstock 40. In one aspect three shear screws 413 are used which shear in response to a force of about 80,000 pounds.

The mill 30 is connected to the whipstock 40 with a shear stud 310 that extends through a lower end of the mill 30 and into the shear lug 403. The mill 30 has a body 301 to which are secured milling blades 302 as are well known in the art. The mill body 301 has a fluid flow bore 303 which communicates with jetting ports 304 with exits adjacent the blades 302. A sub-channel 305 provides fluid communication between the fluid flow bore 303 and the tubing 12. In one aspect the fluid flow bore is sized so that it can receive a plug disengaged from the valve assembly 20 as described below.

FIGS. 3A–3J show the valve assembly 20 and parts thereof. The valve assembly 20 has a top bushing 201 threadedly connected to a valve body 202. A bottom bushing 230 is connected to a lower end of the valve body 202. A piston 203 is movably mounted in a bore 231 of the valve body 202. A plug extension 204 is movably mounted in the valve body 202 with a lower end 232 thereof projecting into and through the lower bushing 230 with respect to which the plug extension 204 is movable up and down. An upper end 233 of the plug extension 204 is threadedly connected in a lower end 234 of the piston 203.

A ratchet sleeve 208 is rotatably disposed around the plug extension 204. A lug 206 projects through the valve body 202 into a multi-branched slot 235 of the ratchet sleeve 208. A spring 207 abuts an upper end 236 of the lower bushing 230 and pushes against (upwardly) a thrust bearing set 238 at a bottom 237 of the ratchet sleeve 208 (see FIG. 3C). A releasable plug 205 initially closes off the lower end 232 of the plug extension 204 to fluid flow. A thrust bearing set 239 is disposed between a top 240 of the ratchet sleeve 208 and the lower end 234 of the piston 203 (see FIG. 3B). This use of thrust bearings inhibits undesirable coiling of the spring 207 and facilitates rotation of the ratchet sleeve 208. The thrust bearing sets may include a typical thrust bearing sandwiched between two thrust washers. Shear screws 215 secure the plug 205 to the plug extension 204. In one aspect two shear screws 215 are used and they shear in response to a force of about 4000 pounds.

A cap 241 emplaced in and welded to a trough 242 serves to define the outer wall of a channel 243 formed between the cap 241 and the exterior of the body 202.

O-rings seal a variety of interfaces: O-ring 212, mill 30/plug extension 204; O-ring 213, plug 205/interior-of-plug-extension 204; O-ring 209, valve-body 202/bottom-bushing 230; O-ring 211, plug-extension 204/piston 203; O-ring 246, piston 203/valve-body 202; O-rings 245 and 247, piston 203/valve-body 202; O-ring 210, piston 203/valve-body 202; O-ring 214, lug 206/body 202; and O-ring 244, valve-body 202/top-bushing 201.

The valve body 202 has a series of ports 249 that permit fluid to flow through the valve body 202 and ports 251 that also permit such fluid flow. The top bushing 201 prevents further upward movement of the piston 203. FIG. 3F shows a cross-section view of the trough 242.

Figure 3B:
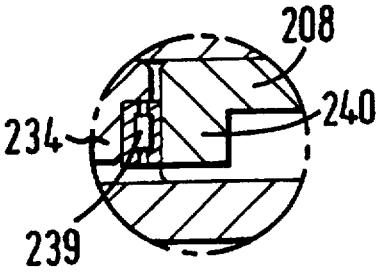
FIGS. 3B–3L are side views in cross-section of parts of the valve assembly of FIG. 3A.
Figure 3C:
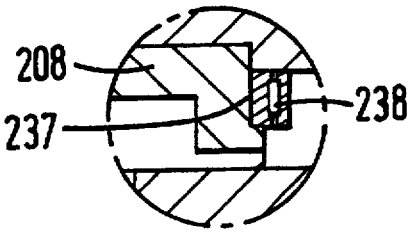
Figure 3A:
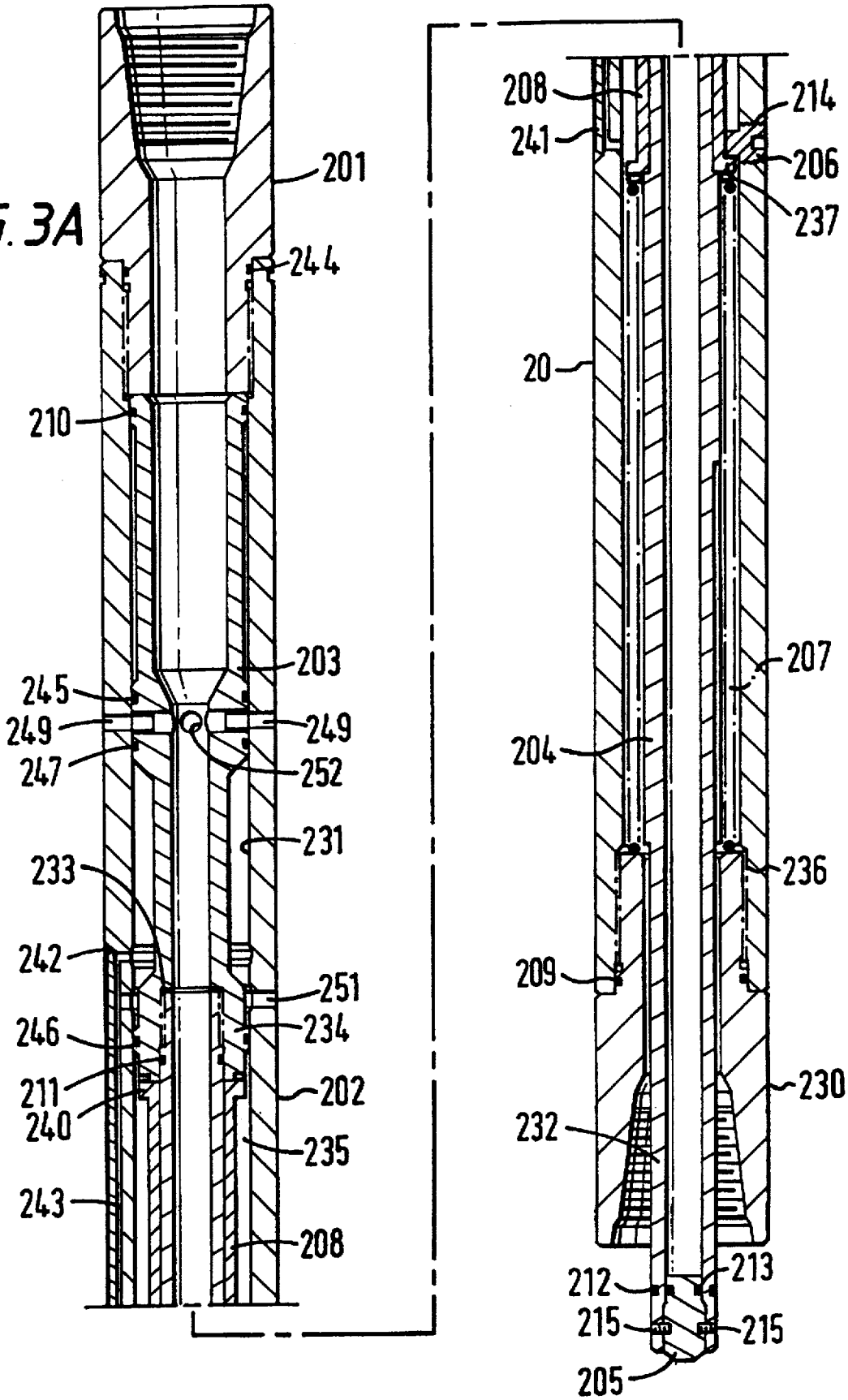
FIG. 3A is a side view in cross-section of the valve assembly of FIG. 1.
Figure 3E:
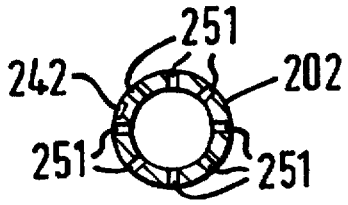
Figure 3F:
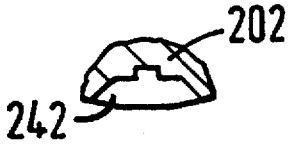
Figure 3D:
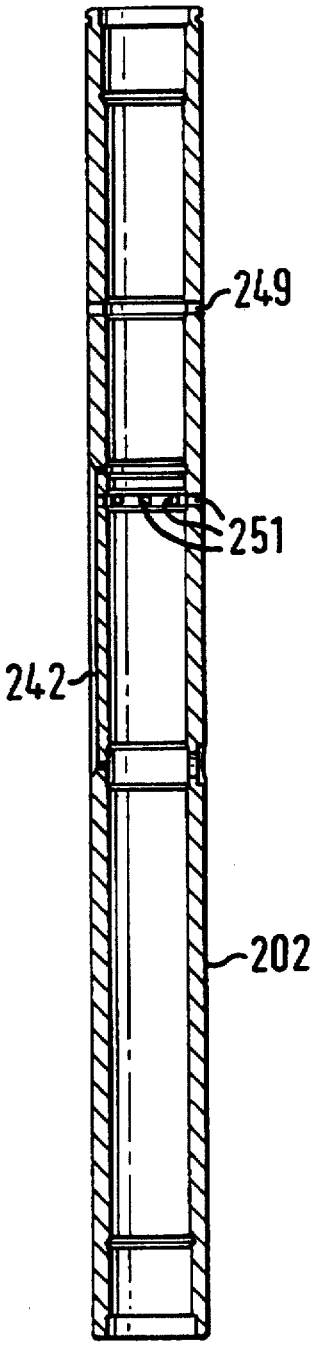
Figure 3G:
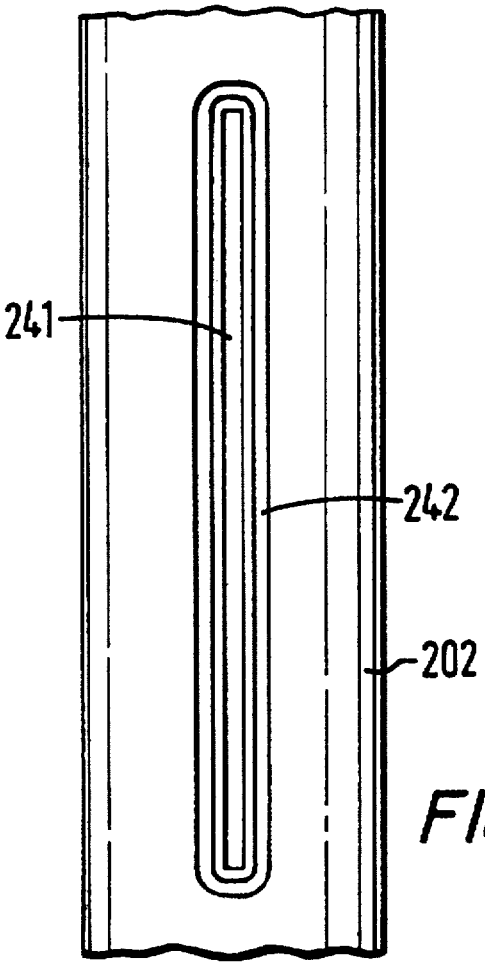
Figure 3H:
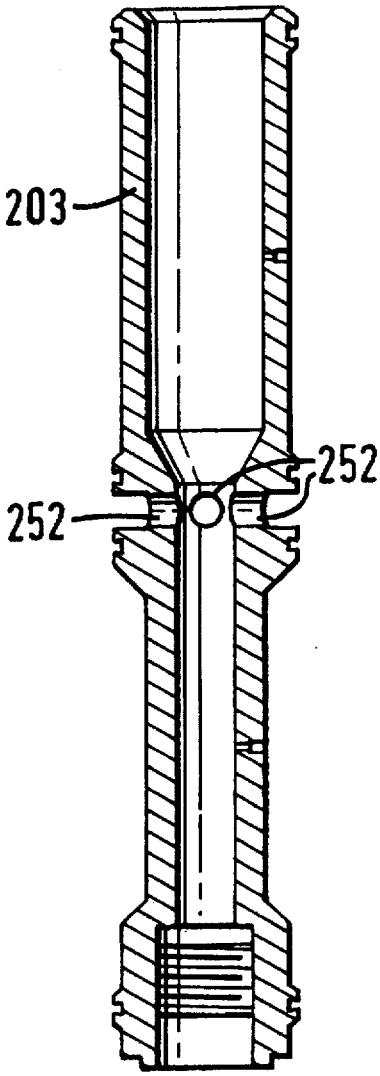
Figure 3I:
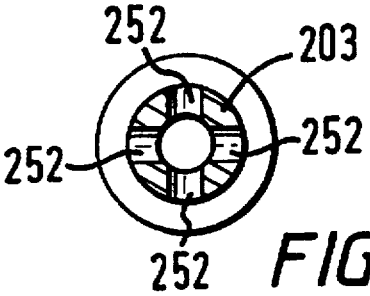

The piston 203 as shown in FIGS. 3A, 3H and 3I, has a series of fluid ports 252 and the piston can be moved so the fluid ports 252 align with the valve body ports 249 or 251 for fluid intercommunication therewith.

Figure 3J:
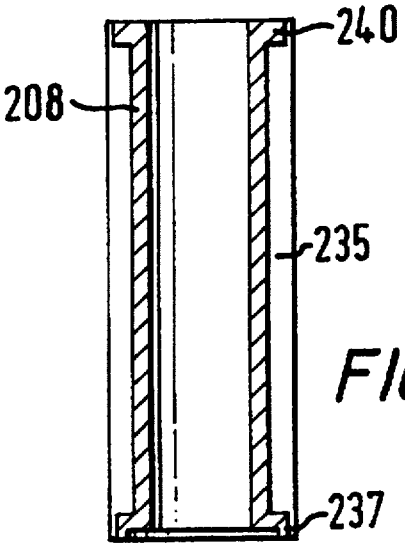
Figure 3L:
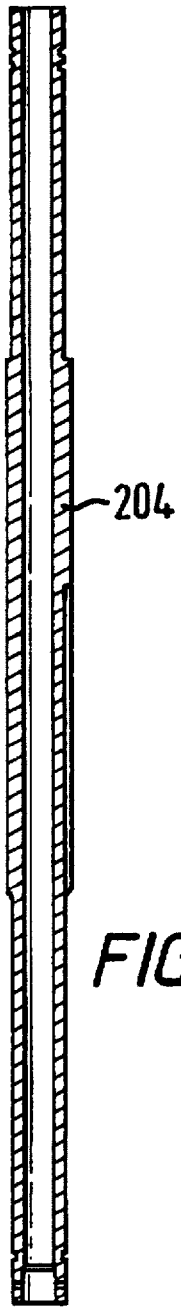
Figure 3K:
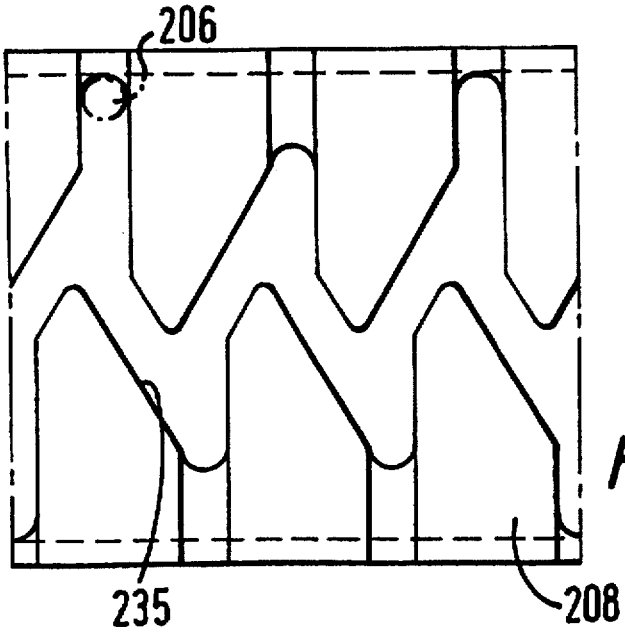

FIGS. 3A, 3J, and 3K show the ratchet sleeve 208 and the multi-branch slot 235 in which moves the lug 206.

FIG. 3L shows the plug extension 204.

FIG. 4 and FIGS. 5A–5F illustrate a sequence of operation of the system 10 and the corresponding movement of and positions of the lug 206 and of the ratchet sleeve 208.

Figure 5A:
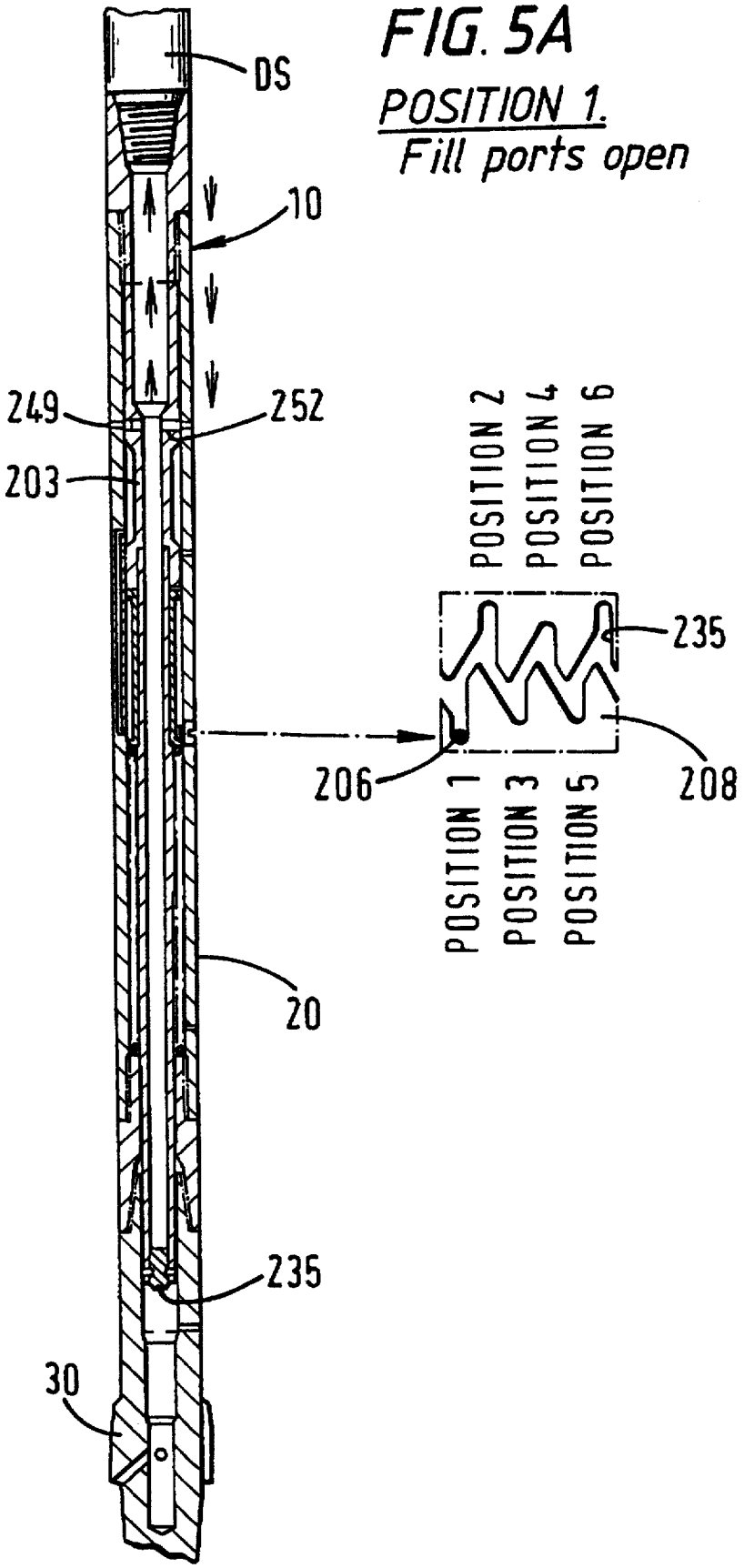
FIGS. 5A–5F show a sequence of operation of the system of FIG. 1.

FIG. 5A illustrates the system 10 in a "run-in-the-hole" situation. The ports 252 and 249 are aligned so fluid from outside the system 10 (e.g. drilling fluid between the exterior of the system 10 and the interior of borehole casing, not shown) may flow, as indicated by the arrows, through the system 10 and up into a drill string to which the system 10 is connected. The lug 206 is in "Position 1" in the multi-branch slot 235.

Figure 5B:
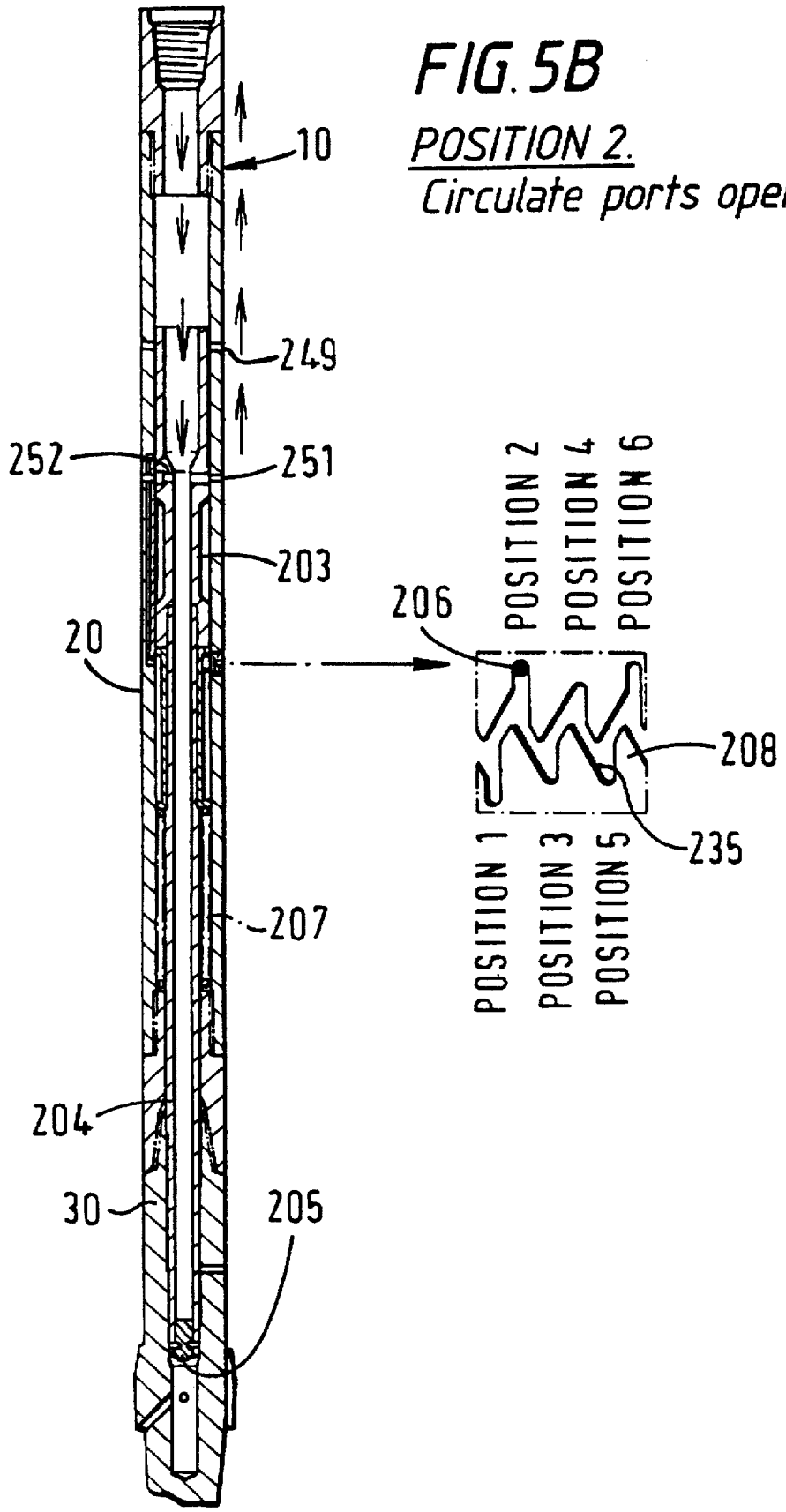

As shown in FIG. 5B, fluid under pressure is pumped from the surface down the drill string into the system 10 with sufficient force to move the piston 203 to the position shown, with the ports ports 251 aligned with the ports 252 permitting fluid pumped down the drill string to flow out from the system 10. The lug 206 moves to the "Position 2" in the ratchet sleeve 208. (The multi-branch slot 235 is continuous around the ratchet sleeve 208 so that the sequence of operation of the system is repeatable as required). In this position fluid may be circulated out from the system 10 to clean the hole at the point at which it is desired to set the system 10, e.g. to remove debris and other material that might interfere with proper system functioning and positioning.

Figure 5C:
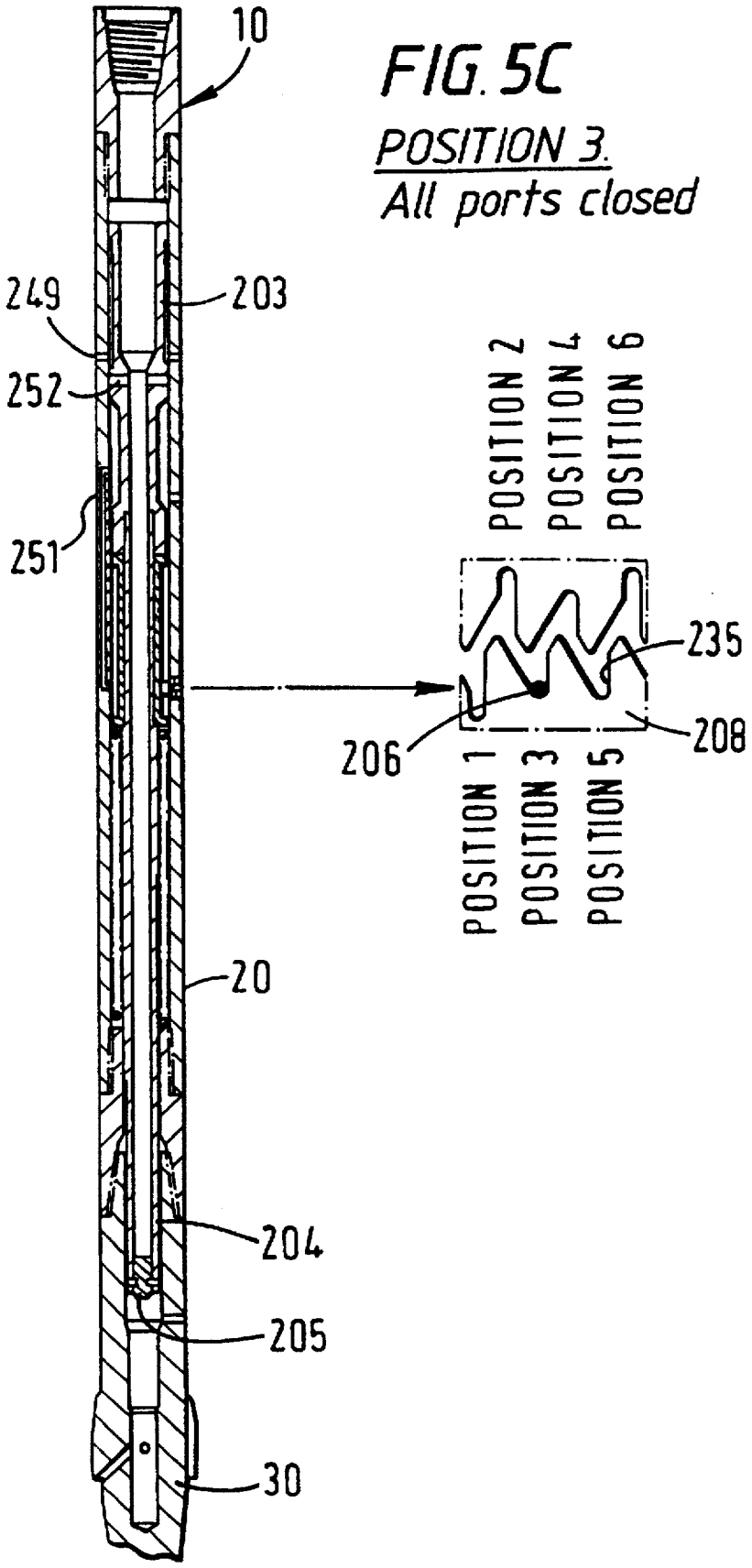

With the system 10 as shown in the position of FIG. 5C, flow is not permitted through the ports 249, 251, and 252 and fluid does not yet flow down to the anchor assembly 50.

Figure 5D:
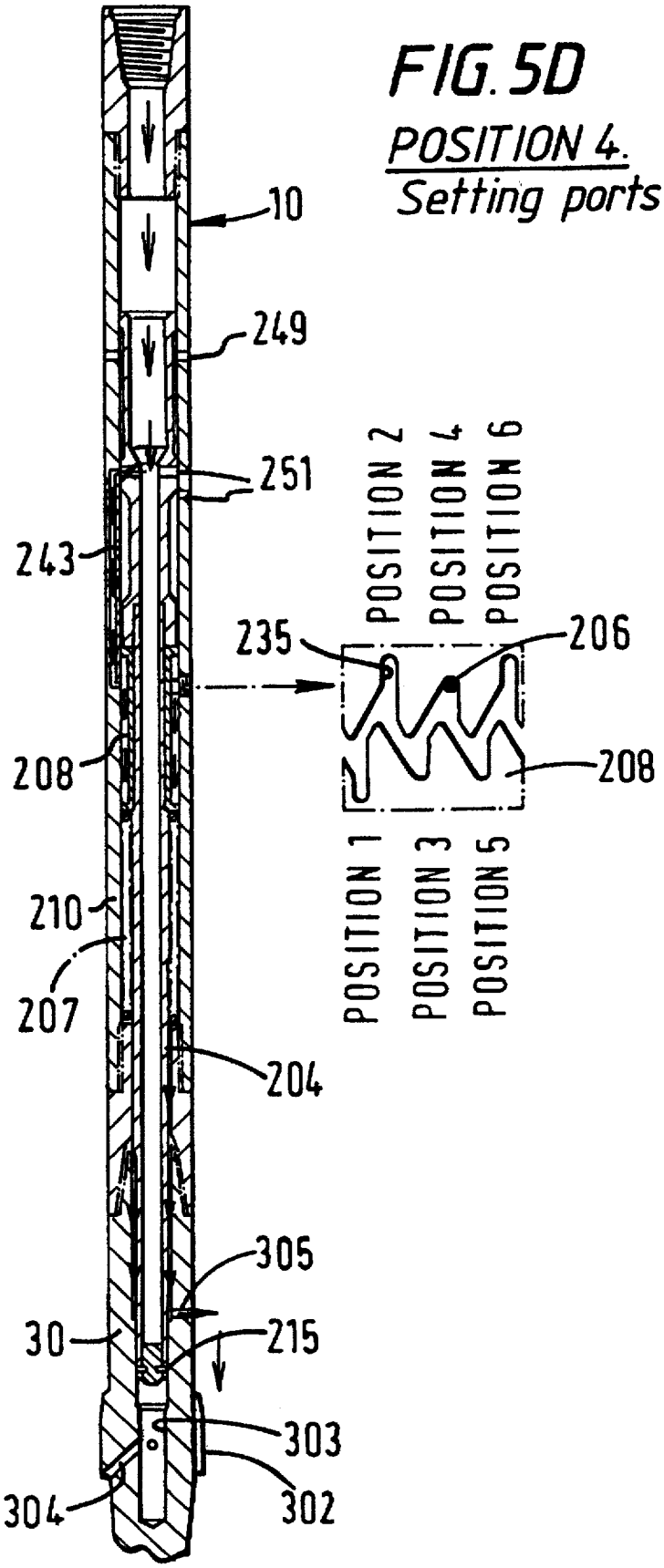
Figure 5E:
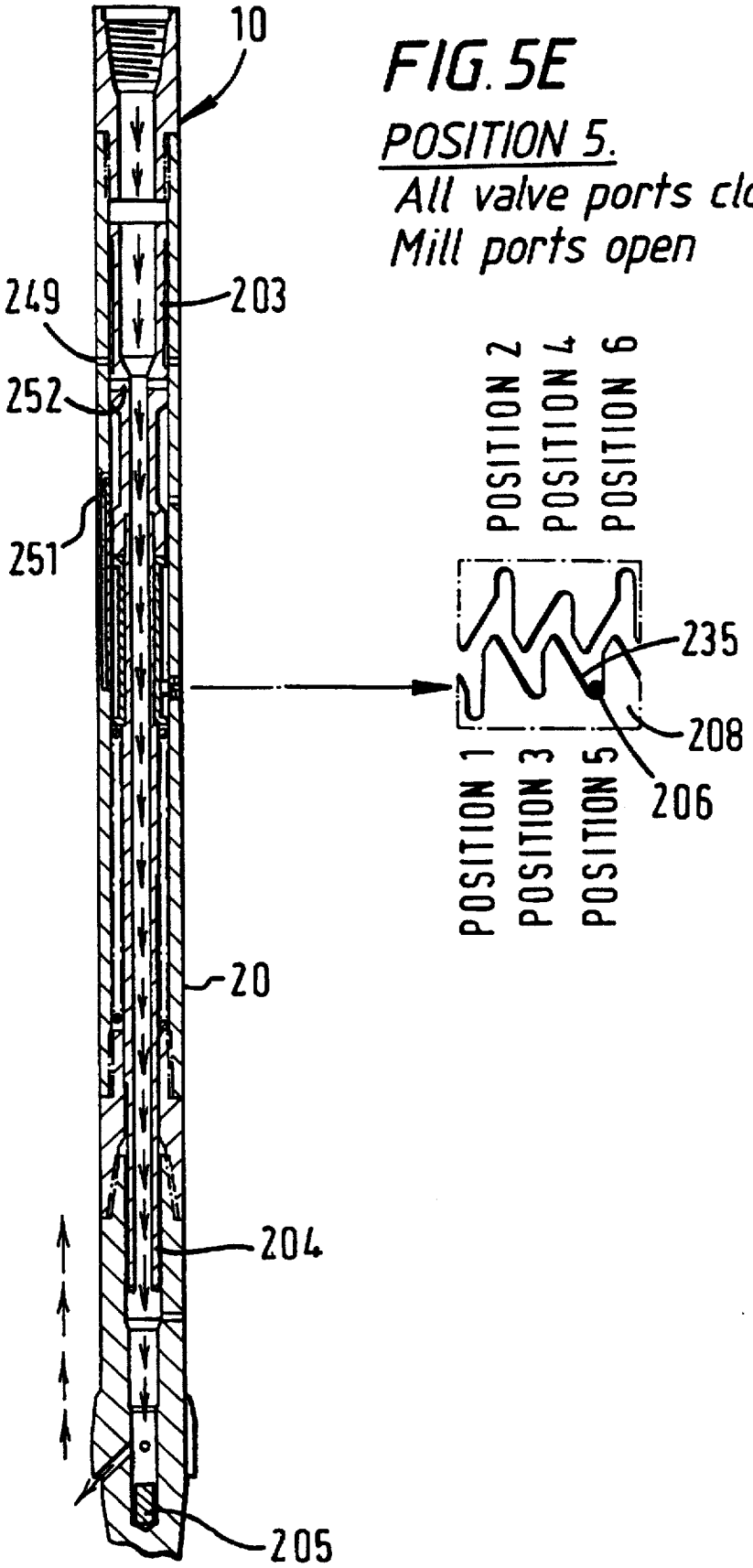

As shown in FIG. 5D, the pressure of fluid flowing into the system has been increased, further moving the piston 203 so ports 259 align with the channel 243. The fluid under pressure flows from the channel 243, past the ratchet sleeve 208, past the spring 207, between the bushing 203 and the plug extension 204, out the sub-channel 305 of the mill body 301 into the tubing 12 (see FIG. 1). The lug 206 moves into "Position 4" as shown. The fluid under pressure flows through the tubing 12, through the whipstock 40, through the anchor assembly 50 into its cavity 533 where it pushes up on the piston assembly 540, shearing the shear screws 532 so the bar 547 is moved up to move the movable slip(s) 550 and set the anchor assembly 50, and thereby set the system 10 at the desired location. Once proper anchoring has been achieved and verified, an appropriate load is applied to the string to which the system 10 and the mill 30 are connected (e.g. about 30,000 pounds) to shear the shear stud 310 to separate the mill 30 from the whipstock 40. Then as shown in FIG. 5E, pressure is increased against the plug 205 which is then released by shearing of the shear screws 215, thereby releasing pressure which was required to set the moving slip, and the spring 207 has pushed upwardly moving the ratchet sleeve 208 and the piston 203 so that all ports (249, 251, 252) are closed to fluid flow and fluid is diverting through the jetting ports 304. The lug 206 is now in "Position 5." Milling now commences. Upon completion of a desired window in casing adjacent the mill 30, the whipstock 40 may be retrieved by using a hook which is inserted into the retrieval slot 404 or by screwing a die collar onto the outer diameter threads (not shown) provided at the top of the whipstock 40. Alternatively, an overpull is applied to the whipstock (e.g. about 82,500 pounds) shearing the shear screws 413 allowing retrieval of the whipstock while leaving the anchor assembly in the hole and/or tubular member string. Such a shearable neck is disclosed in pending U.S. application Ser. No. 08/590,747 entitled "Wellbore Milling Guide" filed on Jan. 24, 1996 and co-owned with the present invention and application and incorporated herein by reference fully and for all purposes.

Figure 5F:
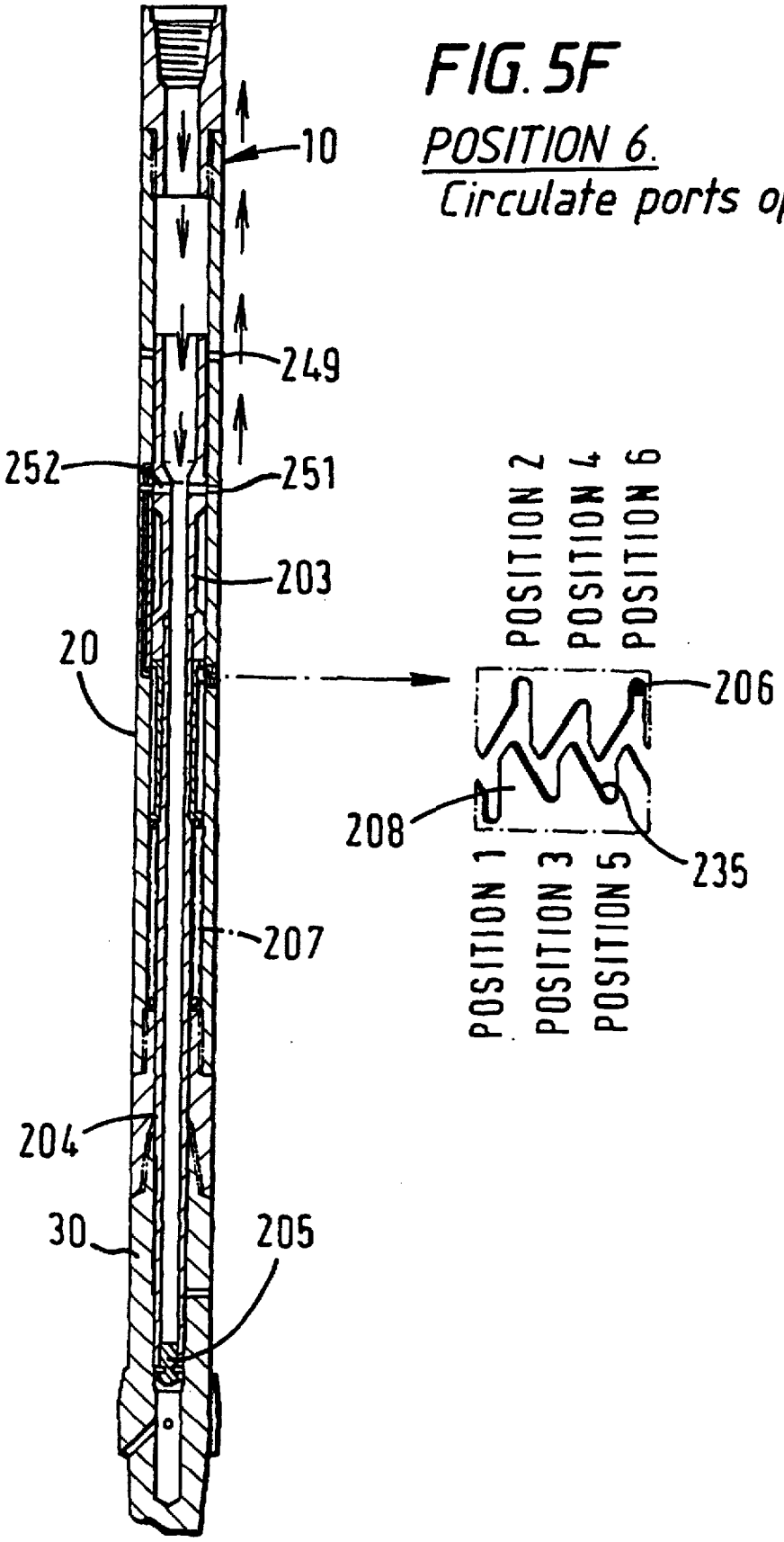

Repetition of the cycle of operation of the system as shown in FIGS. 5A–5F, or of only a portion of the cycle, is possible; e.g., but not limited to as shown in FIG. 5F, cycling back to Position 1 is possible if necessary. Also, if when weight is set down there is an indication that the anchor asembly is not set as desired, the setting sequence can be repeated. Fluid under pressure is again circulated down the drill string and out from the system 10 (to again clean the hole, if desired) and the process of FIGS. 5A–5E is begun again.

It is within the scope of this invention to use an anchor assembly, a valve assembly, and/or a mill according to this invention with any downhole apparatus, device, tool, or combination thereof.

In conclusion, therefore, it is seen that the present invention and the embodiments disclosed herein and those covered by the appended claims are well adapted to carry out the objectives and obtain the ends set forth. Certain changes can be made in the described and in the claimed subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A valve assembly for selectively controlling fluid flow through a hollow tubular in a string of hollow tubulars in a wellbore extending from a surface of the earth into the earth, the valve assembly comprising a hollow body with a hollow piston mounted for reciprocal up and down rotative movement therein, the hollow body having an inwardly projecting lug, the hollow piston having at least one piston fluid flow port therethrough and the hollow body having at least two body fluid flow ports therethrough, a ratchet sleeve connected to the piston, the ratchet sleeve having a branched slot therearound which is movable on the lug so that the ratchet sleeve and the piston are movable to a plurality of positions, the branched slot with a plurality of position recesses, at least one position in which fluid is flowable from within the hollow body to an exterior thereof and at least one position in which fluid is flowable from outside the hollow body thereinto.

2. The valve assembly of claim 1 further comprising the hollow body with a top and a bottom and a valve bore therethrough from top to bottom, the valve body having at least one valve flow port that allows the valve bore to communicate with an exterior of the hollow body, the hollow piston movably and sealingly mounted in the valve bore, the hollow piston having a piston body with a top and a bottom and a piston bore extending therethrough from top to bottom, the hollow piston having at least one piston flow port that allows the valve bore to communicate with the at least one valve flow port so fluid is flowable through the piston, through the at least one piston flow port, and through the at least one valve flow port to the exterior of the hollow body, the hollow body movable so that the branched slot is selectively movable on the lug and so that the valve assembly is selectively movable to any of a series of positions corresponding to the position recesses and to positions of the at least one valve flow port and the at least one piston flow port, a spring abutting a bottom of the ratchet sleeve and an inner surface of a bottom of the valve flow bore, the spring urging the ratchet sleeve and hollow piston upwardly and thereby releasably maintaining the lug in one of the plurality of position recesses, the at least one valve flow port including at least one first valve flow port through the hollow body, and at least one second valve flow port through the hollow body, the at least one second valve flow port disposed below the at least one first valve flow port, and wherein the hollow body has a body channel therethrough with a top end disposed above the at least one second valve port and a bottom end disposed at a level of the lug, and wherein the mill apparatus has a fluid flow bore therethrough and at least one jet port therethrough, the plurality of position recesses including recesses corresponding to a fill position of the system in which the at least one first valve flow port and the at least one piston flow port are aligned so that as the system is run into the wellbore fluid in the wellbore is permitted to fill the system, a circulate position of the system wherein the at least one piston flow port is aligned with the at least one second valve flow port so that fluid in the piston pumped down from the surface is flowable out from the hollow body, a set anchor position of the system in which the at least one piston flow port is aligned with the top end of the body channel so that fluid pumped from the surface is flowable past the ratchet sleeve in a channel within the hollow body and out from the hollow body to the anchor assembly to set the anchor assembly, and a mill position of the system in which fluid under pressure is pumpable through the valve assembly to the mill apparatus to exit the mill apparatus through the at least one jet port, a plug extension connected to the bottom of the hollow piston, the plug extension having a top and a bottom and a plug fluid flow bore therethrough from top to bottom, the bottom of the plug extension projecting out from the bottom of the hollow body, a plug releasably secured in the plug extension by a shearable member, and the shearable member shearable to release the plug in response to fluid pumped from the surface to the valve assembly, such fluid passing through the hollow piston and through the plug extension, thereby opening the plug fluid flow bore to fluid flow and releasing pressure of fluid on the anchor assembly, and the plug extension projecting into the milling apparatus and the milling apparatus having a bore for receiving the plug upon its separation from the plug extension, the bore disposed so that the plug does not block fluid flow to the at least one jet port.

3. The mill system of claim 2 wherein the branched slot extends around the entire ratchet sleeve for cycling of the valve assembly.

4. A milling system for milling an opening in a tubular in a tubular string in a wellbore extending down from a surface of the earth, the milling system comprising an anchor assembly comprising a body, a slip movably mounted to the body, the body having a fluid flow bore therethrough, the fluid flow bore having an enlarged cavity and a bottom cavity, a piston movably mounted in the fluid flow bore, the piston having a top and a bottom and with a piston flow bore therethrough from top to bottom through which fluid from the surface is flowable through the piston into the bottom cavity to force the piston upwardly in the enlarged cavity to move the slip from the body to set the anchor assembly in the tubular, a whipstock connected to the anchor assembly, a mill apparatus releasably connected to the whipstock, a valve assembly connected at a top end thereof to the tubular string and at a bottom end thereof to the mill apparatus for selectively controlling fluid flow from the surface to the anchor assembly, and the anchor assembly further comprising a hollow stem extending from an end of the fluid flow bore of the body of the anchor at a top of the enlarged cavity to a top of the piston so that fluid from the surface is flowable through the fluid flow bore of the body of the anchor, through the hollow stem into the piston flow bore, the hollow stem preventing fluid from flowing into the enlarged cavity above the piston, and the hollow stem movable up into the fluid flow bore of the body of the anchor as the piston moves upwardly in the enlarged cavity.

5. A milling system for milling an opening in a tubular in a tubular string in a wellbore extending down from a surface of the earth, the milling system comprising an anchor assembly comprising a body, a slip movably mounted to the body, the body having a fluid flow bore therethrough, the fluid flow bore having an enlarged cavity and a bottom cavity, a piston movably mounted in the fluid flow bore, the piston having a top and a bottom and with a piston flow bore therethrough from top to bottom through which fluid from the surface is flowable through the piston into the bottom cavity to force the piston upwardly in the enlarged cavity to move the slip from the body to set the anchor assembly in the tubular, a whipstock connected to the anchor assembly, a mill apparatus releasably connected to the whipstock, a valve assembly connected at a top end thereof to the tubular string and at a bottom end thereof to the mill apparatus for selectively controlling fluid flow from the surface to the anchor assembly, and the anchor assembly further comprising a screw in the body with a portion projecting outwardly from the body to stop upward movement of the slip.

6. A milling system for milling an opening in a tubular in a tubular string in a wellbore extending down from a surface of the earth, the milling system comprising an anchor assembly comprising a body, a slip movably mounted to the body, the body having a fluid flow bore therethrough, the fluid flow bore having an enlarged cavity and a bottom cavity, a piston movably mounted in the fluid flow bore, the piston having a top and a bottom and with a piston flow bore therethrough from top to bottom through which fluid from the surface is flowable through the piston into the bottom cavity to force the piston upwardly in the enlarged cavity to move the slip from the body to set the anchor assembly in the tubular, a whipstock connected to the anchor assembly, a mill apparatus releasably connected to the whipstock, a valve assembly connected at a top end thereof to the tubular string and at a bottom end thereof to the mill apparatus for selectively controlling fluid flow from the surface to the anchor assembly, and the anchor assembly further comprising a spring with a top end and a bottom end disposed in the enlarged cavity with the top end abutting a lower surface of the top of the piston and the bottom abutting an inner surface of a bottom of the enlarged cavity so that the spring urges the piston upwardly and prevents downward piston movement thereby maintaining the slip in an extended position once it has been moved by the piston.

7. The milling system of claim 6 further comprising the anchor assembly further comprising a shearable member initially holding the piston down, the shearable member shearable in response to force on the piston by fluid pumped from the surface into the bottom cavity, and the shearable member initially holding the piston against force of the spring and preventing the spring from urging the piston upwardly.

8. A milling system for milling an opening in a tubular in a tubular string in a wellbore extending down from a surface of the earth, the milling system comprising an anchor assembly comprising a body, a slip movably mounted to the body, the body having a fluid flow bore therethrough, the fluid flow bore having an enlarged cavity and a bottom cavity, a piston movably mounted in the fluid flow bore, the piston having a top and a bottom and with a piston flow bore therethrough from top to bottom through which fluid from the surface is flowable through the piston into the bottom cavity to force the piston upwardly in the enlarged cavity to move the slip from the body to set the anchor assembly in the tubular, a whipstock connected to the anchor assembly, a mill apparatus releasably connected to the whipstock, a valve assembly connected at a top end thereof to the tubular string and at a bottom end thereof to the mill apparatus for selectively controlling fluid flow from the surface to the anchor assembly, and the valve assembly further comprising a hollow body with a top and a bottom and a valve bore therethrough from top to bottom, the valve body having at least one valve flow port that allows the valve bore to communicate with space exterior to the hollow body, a valve piston sealingly and movably mounted in the valve bore, the valve piston having a piston body with a top and a bottom and a piston bore extending therethrough from top to bottom, the valve piston having at least one piston flow port that allows the valve bore to communicate with the at least one valve flow port so fluid is flowable through the piston, through the at least one piston flow port, and through the at least one valve flow port to the exterior of the hollow body, a ratchet sleeve connected to the piston body and having a branched slot, the branched slot with a plurality of position recesses, a lug projecting inwardly from an interior surface of the hollow body into the branched slot, the hollow body movable with respect to the ratchet sleeve and rotatable with respect to the ratchet sleeve so that the branched slot is selectively movable on the lug to any of a series of positions corresponding to various positions of the at least one valve flow port and the at least one piston flow port.

9. The milling system of claim 8 further comprising the valve assembly further comprising a spring abutting a bottom of the ratchet sleeve and an inner surface of a bottom of the valve flow bore, and the spring urging the ratchet sleeve and valve piston upwardly and thereby releasably maintaining the lug in one of the plurality of position recesses.

10. The milling system of claim 8 wherein the at least one valve flow port includes at least one first valve flow port through the hollow body, and at least one second valve flow port through the hollow body, the at least one second valve flow port disposed below the at least one first valve flow port, and wherein the hollow body has a body channel therethrough with a top end disposed above the at least one second valve port and a bottom end disposed at a level of the lug, and wherein the mill apparatus has a fluid flow bore therethrough and at least one jet port therethrough, and the milling system further comprising the plurality of position recesses including recesses corresponding to a fill position of the system in which the at least one first valve flow port and the at least one piston flow port are aligned so that as the system is run into the wellbore fluid in the wellbore is permitted to fill the system, a circulate position of the system wherein the at least one piston flow port is aligned with the at least one second valve flow port so that fluid in the piston pumped down from the surface is flowable out from the hollow body, a set anchor position of the system in which the at least one piston flow port is aligned with the top end of the body channel so that fluid pumped from the surface is flowable past the ratchet sleeve in a channel within the hollow body and out from the hollow body to the anchor assembly to set the anchor assembly, and a mill position of the system in which fluid under pressure is pumpable through the valve assembly to the mill apparatus to exit the mill apparatus through the at least one jet port.

11. The milling system of claim 10 further comprising the valve assembly further comprising a plug extension connected to the bottom of the piston, the plug extension having a top and a bottom and a plug fluid flow bore therethrough from top to bottom, the bottom of the plug extension projecting out from the bottom of the hollow body, a plug releasably secured in the plug extension by a shearable member, and the shearable member shearable to release the plug in response to fluid pumped from the surface to the valve assembly, such fluid passing through the piston and through the plug extension to shear the shearable member, thereby opening the plug fluid flow bore to fluid flow and releasing pressure of fluid on the anchor assembly.

12. The milling system of claim 11 wherein the plug extension projects into the milling apparatus and the milling apparatus has a bore for receiving the plug upon separation of the plug from the plug extension, the bore disposed so that the plug does not block fluid flow to the at least one jet port.

13. The milling system of claim 8 wherein the branched slot extends around the entire ratchet sleeve for cycling of the valve assembly.

* * * * *

UNITED STATES PATENT AND TRADEMARK OFFICE

CERTIFICATE OF CORRECTION

PATENT NO. : 5,743,331

DATED : April 28, 1998

INVENTOR(S) : Adkins et al

It is certified that error appears in the above-identified patent and that said Letters Patent is hereby corrected as shown below:

Col. 10, line 16, change ''the'' to --a--

Col. 10, line 33, change ''to the'' to --to an--

Col. 10, line 58, change ''mill system'' to --valve assembly--

Signed and Sealed this

Twenty-ninth Day of September, 1998

*Attest:*

*Attesting Officer*

Bruce Lehman

BRUCE LEHMAN

*Commissioner of Patents and Trademarks*